US006536530B2

(12) United States Patent
Schultz et al.

(10) Patent No.: US 6,536,530 B2
(45) Date of Patent: Mar. 25, 2003

(54) HYDRAULIC CONTROL SYSTEM FOR DOWNHOLE TOOLS

(75) Inventors: Roger L. Schultz, Aubrey, TX (US); Paul D. Ringgenberg, Spring, TX (US); Jimmie R. Williamson, Jr., Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/848,562

(22) Filed: May 3, 2001

(65) Prior Publication Data

US 2001/0037884 A1 Nov. 8, 2001

(30) Foreign Application Priority Data

May 4, 2000 (WO) ..... PCT/US00/12329

(51) Int. Cl.[7] ..... E21B 34/10; F15B 11/16
(52) U.S. Cl. ..... 166/375; 166/386; 166/321
(58) Field of Search ..... 166/381, 386, 166/375, 67, 162, 177.5, 319, 320, 321

(56) References Cited

U.S. PATENT DOCUMENTS 3,702,909 A 11/1972 Kraakman
4,407,183 A 10/1983 Milberger et al.
4,945,995 A * 8/1990 Tholance et al. ..... 166/321

FOREIGN PATENT DOCUMENTS

| | | |
|---|---|---|
| GB | 2 335 216 A | 9/1999 |
| WO | WO 97/47852 | 12/1997 |
| WO | WO 99/47788 | 9/1999 |
| WO | WO 00/09855 | 2/2000 |

OTHER PUBLICATIONS

International Search Report For Application No.: PCT/US00/12329.

* cited by examiner

*Primary Examiner*—David Bagnell
*Assistant Examiner*—Jennifer R. Dougherty
(74) *Attorney, Agent, or Firm*—J. Richard Konneker

(57) ABSTRACT

A hydraulic control system for downhole tools enables convenient selection and actuation of a well tool assembly from among multiple well tool assemblies installed in a well. Each well tool assembly includes a control module having a selecting device and a fluid metering device. A predetermined range of pressure levels on one of multiple hydraulic lines causes the well tool assembly to be selected for actuation, a differential between pressure on that hydraulic line and pressure on another hydraulic line determines a manner of actuating the selected well tool assembly, and pressure fluctuations on one of the hydraulic lines causes fluid to be transferred from another hydraulic line to an actuator of the well tool assembly.

29 Claims, 7 Drawing Sheets

10
40
34
36
38
12
26
24
20
14
28
24
20
52
24
16
30
20
18
32
24
20

HYDRAULIC CONTROL SYSTEM FOR DOWNHOLE TOOLS

CROSS-REFERENCE TO RELATED APPLICATION

This application claims the benefit of the filing date of PCT International Application No. PCT/US00/12329, filed May 4, 2000.

TECHNICAL FIELD

The present invention relates generally to operations performed and equipment utilized in conjunction with subterranean wells and, in an embodiment described herein, more particularly provides a system for hydraulically controlling actuation of downhole tools.

BACKGROUND

It is very advantageous to be able to independently control well tools from the earth's surface, or other remote location. For example, production from one of several zones intersected by a well may be halted due to water invasion, while production continues from the other zones. Alternatively, one zone may be in communication with a production tubing string, while the other zones are shut in.

In order to control multiple downhole well tools, various systems have been proposed and used. One type of system utilizes electrical signals to select from among multiple well tools for operation of the selected tool or tools. Another type of system utilizes pressure pulses on hydraulic lines, with the pulses being counted by the individual tools, to select particular tools for operation thereof.

Unfortunately, these systems suffer from fundamental disadvantages. The systems which use electrical communication or power to select or actuate a downhole tool typically have temperature limitations for electrical circuitry thereof or are prone to conductivity and insulation problems, particularly where integrated circuits are utilized or connectors are exposed to well fluids. The systems which use pressure pulses are typically very complex and, therefore, expensive to manufacture and difficult to maintain.

From the foregoing, it can be seen that it would be quite desirable to provide a well control system which does not use electricity or complex pressure pulse counting mechanisms, but which provides a reliable, simple and cost effective means of controlling downhole tools. It is accordingly an object of the present invention to provide such a well control system and associated methods of controlling well tools.

SUMMARY

In carrying out the principles of the present invention, in accordance with an embodiment thereof, a well control system is provided which permits convenient control over the actuation of well tool assemblies in a well. The system permits independent control of individual ones of the well tool assemblies. Associated methods are also provided.

In one aspect of the present invention, a system for selectively actuating multiple well tool assemblies is provided. Multiple hydraulic lines are connected to the multiple well tool assemblies, with each of the hydraulic lines being connected to an actuation control module of each of the well tool assemblies. Each control module includes a selecting device and a fluid metering device.

The selecting device compares pressure on one of the hydraulic lines to a reference pressure source. The well tool assembly associated with the selecting device is selected when the pressure on the hydraulic line is greater than the reference pressure by a predetermined amount, but differs from the reference pressure by less than another predetermined amount. The predetermined amounts may be determined by relief valves of the selecting device interconnected between the hydraulic line and the reference pressure source.

The fluid metering device transfers fluid from the hydraulic line to an actuator of the associated well tool assembly in response to alternating pressure increases and decreases on another one of the hydraulic lines. The fluid transferring function is only performed when the well tool assembly is selected.

In another aspect of the present invention, an actuation control module is provided for selectively actuating a well tool assembly in a well. At least two hydraulic lines and a reference pressure source are connected to the control module. A selecting device of the control module includes two valves interconnected in series between one of the hydraulic lines and a fluid metering device of the control module. One of the valves opens when pressure on the hydraulic line is greater than a reference pressure by a first predetermined amount, and the other valve closes when pressure on the hydraulic line is greater than the reference pressure by a second predetermined amount.

The fluid metering device includes two pumps. One of the pumps transfers fluid from a first hydraulic line to an actuator of the well tool assembly in response to fluctuations in pressure on a second hydraulic line, and the other pump transfers fluid from the second hydraulic line to the actuator in response to fluctuations in pressure on the first hydraulic line.

In each case, the fluid is transferred via a different output of the control module, so that the actuator may be operated in a chosen manner by selecting which of the pumps is to be used. Selection of the pump to use is accomplished by merely applying a greater pressure to one of the hydraulic lines as compared to the other hydraulic line after the well tool assembly has been selected.

Each of the pumps includes a metering chamber having a known volume. Thus, a known volume of fluid may be transferred to the actuator, in order to produce a known displacement of a piston of the actuator.

In yet another aspect of the present invention, a method is provided for selectively controlling actuation of multiple well tool assemblies. The method includes the steps of positioning the well tool assemblies in a well; connecting first and second hydraulic lines to each well tool assembly; selecting one of the well tool assemblies for actuation thereof by applying a predetermined pressure to the first and second hydraulic lines; and actuating the selected well tool assembly by applying another greater pressure to one of the hydraulic lines.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
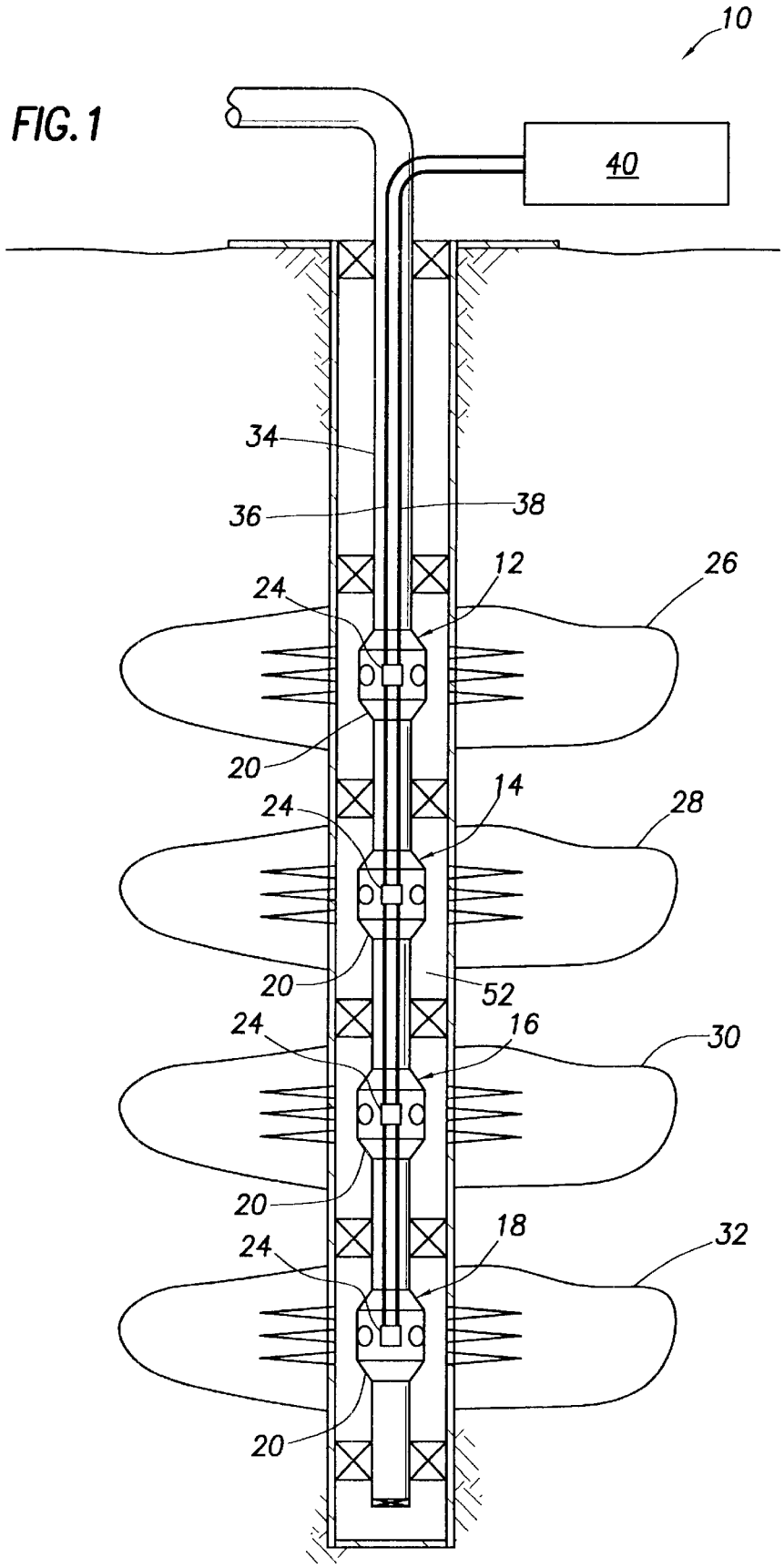
FIG. 1 is a schematic view of a method of selectively controlling the actuation of downhole tools, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, multiple well tool assemblies 12, 14, 16, 18 are positioned in a well. As depicted in FIG. 1, each of the well tool assemblies 12, 14, 16, 18 includes a well tool 20, an actuator 22 for operating the well tool (not visible in FIG. 1, see FIGS. 2–7) and an actuation control module 24. The well tool 20 of each of the assemblies 12, 14, 16, 18 representatively illustrated in FIG. 1 is shown as a valve, the valves being used in the method 10 for controlling fluid flow between formations or zones 26, 28, 30, 32 intersected by the well and a tubular string 34 in which the tool assemblies are interconnected. However, it is to be clearly understood that other types of well tools and well tool assemblies may be utilized, without departing from the principles of the present invention, and it, is not necessary for the well tool assemblies to be interconnected in a tubular string or for the well tool assemblies to be used for controlling fluid flow.

Each of the tool assemblies 12, 14, 16, 18 is connected to hydraulic lines 36, 38 extending from a hydraulic control unit 40 at the earth's surface or other remote location. The hydraulic control unit 40 is of the type well known to those skilled in the art which is capable of regulating fluid pressure on the hydraulic lines 36, 38. The control unit 40 may be operated manually or by computer, etc., and may perform other functions as well.

Preferably, the tool assemblies 12, 14, 16, 18 are Interval Control Valves commercially available from Halliburton Energy Services, Inc. and welt known to those skilled in the art, which are useful in regulating fluid flow rate therethrough in the manner of flow chokes. That is, the valves 20 may each variably restrict fluid flow therethrough, rather than merely permit or prevent fluid flow therethrough, so that an optimal flow rate for each of the zones 26, 28, 30, 32 may be independently established. To vary the restriction to fluid flow, the Interval Control Valve includes a flow choking member which is displaced by a hydraulic actuator, such as the actuator 22 depicted schematically in FIGS. 2–7.

Figure 2:
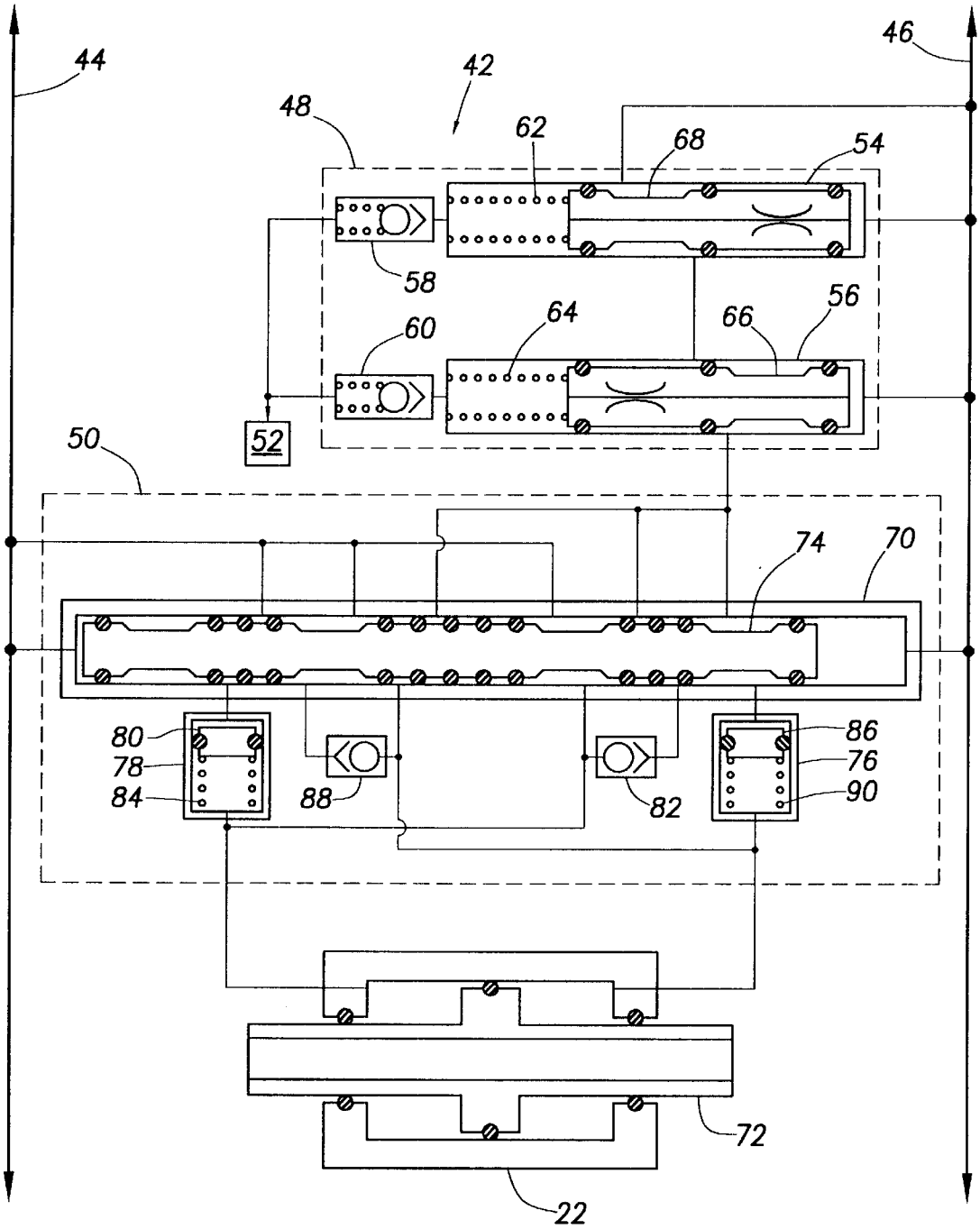
FIG. 2 is a schematic view of a first apparatus usable in the method of FIG. 1, the first apparatus embodying principles of the present invention, and the first apparatus being shown in a configuration prior to a well tool associated with the apparatus being selected for actuation thereof.

Referring additionally now to FIG. 2, an actuation control module 42 embodying principles of the present invention is representatively illustrated interconnected between two hydraulic lines 44, 46 and the actuator 22. The control module 42 may be used for any of the control modules 24 in the method 10, in which case the hydraulic lines 44, 46 would correspond to the hydraulic lines 36, 38 shown in FIG. 1, and the actuator 22 would correspond to an actuator of any of the well tools 20. However, it is to be clearly understood that the control module 42 may be used in other methods and the actuator 22 may be that of another type of well tool, without departing from the principles of the present invention.

The control module 42 includes a selecting device 48 and a fluid metering device 50. The selecting device 48 senses fluid pressure on the hydraulic line 46 and determines whether the control module 42 has been selected for actuation of its corresponding actuator 22. This determination is accomplished by comparing the pressure on the hydraulic line 46 with a reference pressure source 52. In this embodiment, and in the case where the control module 42 is used in the method 10, the reference pressure source 52 is an annulus in the well external to the tubular string 34. Thus, the selecting device 48 compares the pressure on the hydraulic line 46 to hydrostatic pressure in the annulus 52 to determine whether the control module 42 is selected for operation of its corresponding actuator 22.

To make this determination, the selecting device 48 includes two shuttle valves 54, 56 and two relief valves 58, 60. The shuttle valve 54 is normally open and is biased to the open position by a spring 62. A similar spring 64 biases the shuttle valve 56 to a normally closed position. Only when both of the shuttle valves 54, 56 are open is fluid flow permitted from the hydraulic line 46 to the fluid metering device 50 for operation of the actuator 22. Thus, the control module 42 is selected for operation of its corresponding actuator 22 when both of the shuttle valves 54, 56 are open.

Figure 4:
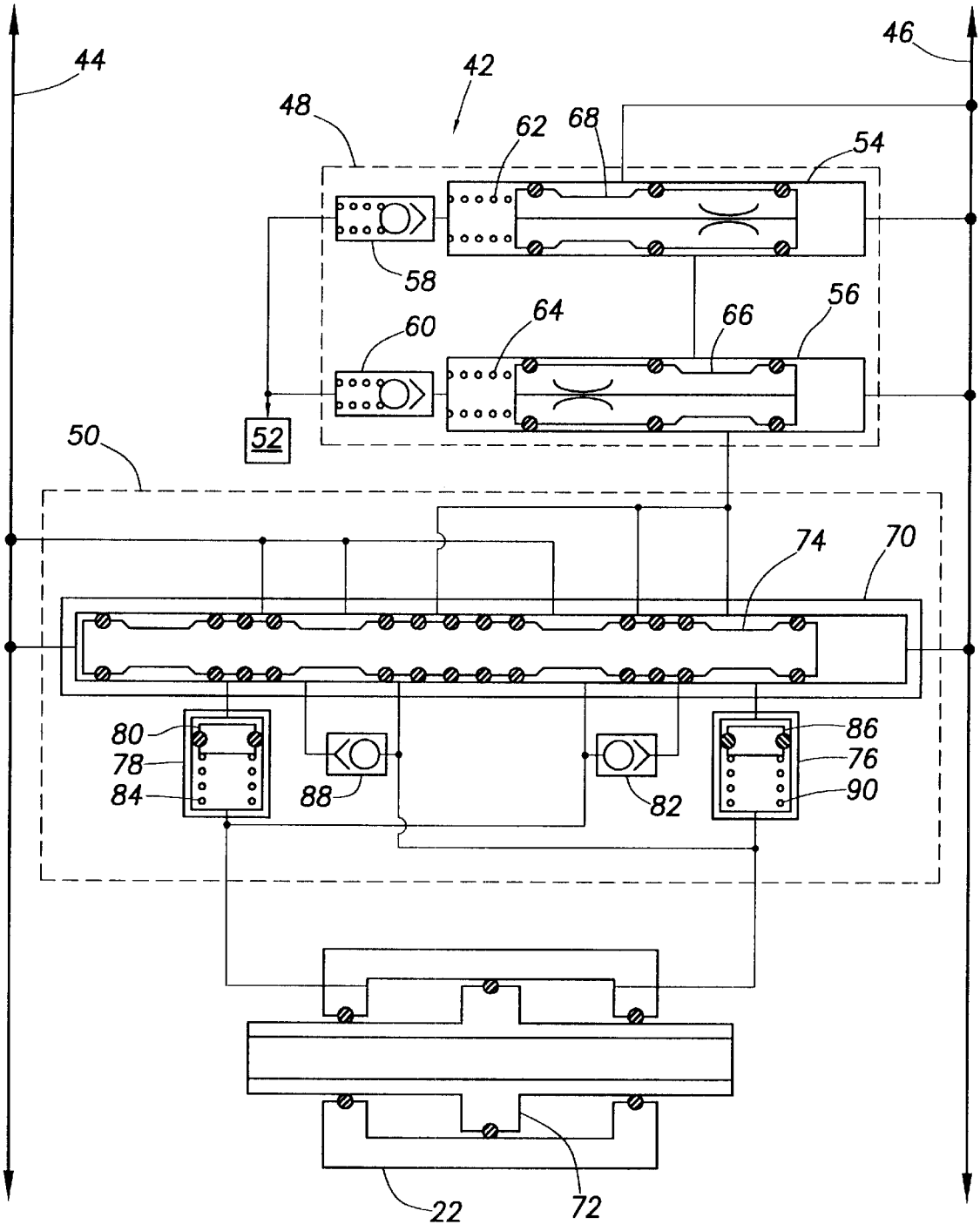
FIG. 4 is a schematic view of the first apparatus shown in a configuration subsequent to the well tool being deselected.

Fluid pressure on the hydraulic line 46 biases a shuttle 66 of the valve 56 to the left as viewed in FIG. 2, which is toward an open position of the valve. However, for the shuttle 66 to displace to the left, pressure on the hydraulic line 46 must overcome the biasing force exerted by the annulus 52 pressure and open the relief valve 60. That is, pressure on the hydraulic line 46 must be somewhat greater than the annulus 52 pressure plus the pressure rating of the relief valve 60. Thus, the relief valve 60 is used in the control module 42 to set a lower limit pressure by which the pressure on the hydraulic line 46 must exceed the pressure on the annulus 52 for the control module to be selected. FIG. 4 depicts the configuration of the control module 42 when pressure on the hydraulic line 46 has exceeded the annulus 52 pressure plus the pressure rating of the relief valve 60, the shuttle 66 being displaced to the left and opening the valve 56.

In a similar manner, the shuttle valve 54 includes a shuttle 68 which is displaced to the left as viewed in FIG. 2 to close the valve. Pressure on the hydraulic line 46 must exceed the pressure on the annulus 52 plus the pressure rating of the relief valve 58 for the shuttle 68 to displace to the left. Thus, the relief valve 58 is used in the control module 42 to set an upper limit pressure by which the pressure on the hydraulic line 46 must not exceed the pressure on the annulus 52 for the control module to be selected.

Therefore, for the control module 42 to be selected, pressure on the hydraulic line 46 must exceed the annulus 52 pressure plus the pressure rating of the relief valve 60, and must not exceed the annulus pressure plus the pressure rating of the relief valve 58. It will be readily appreciated that, by varying the pressure ratings of the relief valves 58, 60, different control modules 42 may be configured to have different ranges of pressures at which the individual control modules are selected. For example, the control module 24 of the tool assembly 12 in the method 10 may be configured so that it is selected when the pressure on the hydraulic line 38 is between 500 and 1,000 psi greater than the annulus 52 pressure, the control module of the tool assembly 14 may be configured so that it is selected when the pressure on the hydraulic line 38 is between 1,500 and 2000 psi greater than the annulus pressure, etc. Thus, each of the well tool assemblies 12, 14, 16, 18 may be independently selected by merely varying the pressure on the hydraulic line 38.

The fluid metering device 50 is responsive to a differential between the pressures on the hydraulic lines 44, 46 to shift a spool valve 70 between one configuration in which fluid is metered from the hydraulic line 46 in response to alternating fluid pressure increases and decreases on the hydraulic line 44, and another configuration in which fluid is metered from the hydraulic line 44 in response to alternating fluid pressure increases and decreases on the hydraulic line 46. Thus, after the control module 42 has been selected by an appropriate pressure on the hydraulic line 46, pressure on one of the hydraulic lines 44, 46 is varied to transfer fluid from the other hydraulic line to the actuator 22. The hydraulic line on which the pressure is alternately increased and decreased determines whether a piston 72 of the actuator 22 is incrementally displaced to the right or to the left as viewed in FIG. 2.

Displacement of the piston 72 in increments is particularly useful where, as in the method 10, the actuator 22 is included in a well tool assembly used to variably restrict fluid flow therethrough. That is, incremental displacement of the piston 72 may be used to incrementally vary the rate of fluid flow through any of the tool assemblies 12, 14, 16, 18, so that the flow rate may be optimized for each of the associated zones 26, 28, 30, 32.

Figure 3:
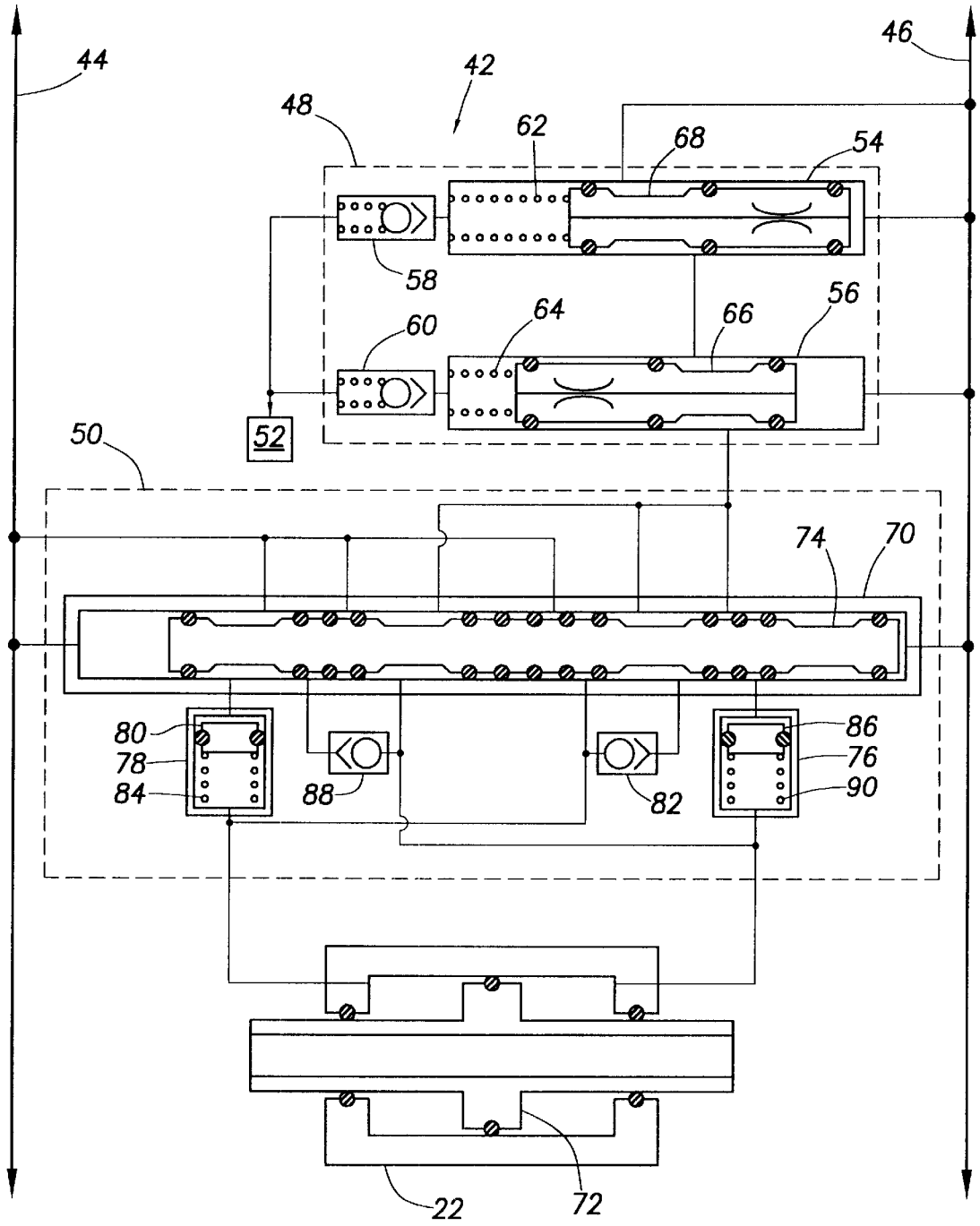
FIG. 3 is a schematic view of the first apparatus shown in a configuration subsequent to the selection of the well tool for actuation thereof in a first manner.
Figure 5:
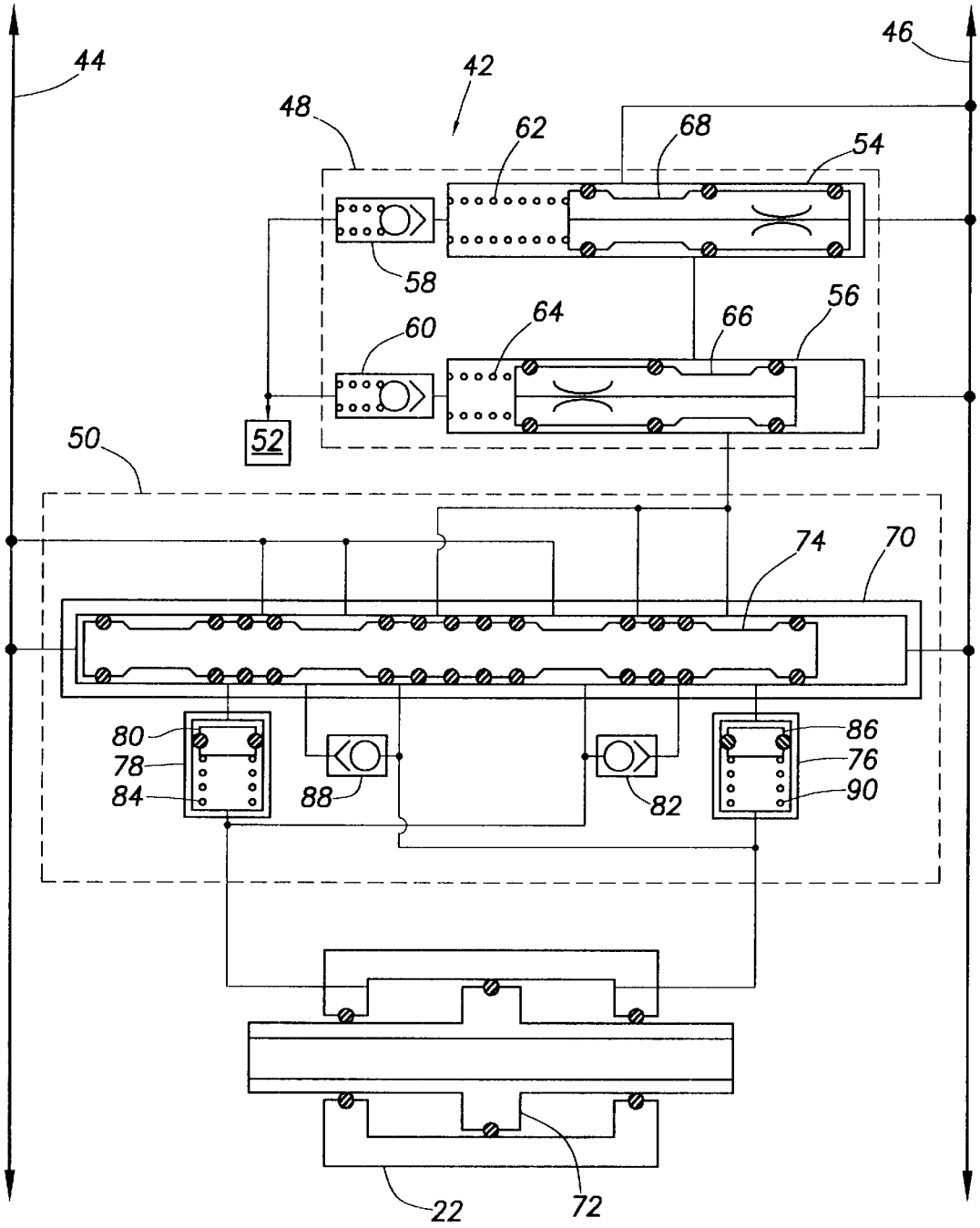
FIG. 5 is a schematic view of the first apparatus shown in a configuration subsequent to the selection of the well tool for actuation thereof in a second manner.

FIG. 5 depicts the configuration of the control module 42 when the module has been selected (i.e., pressure on the hydraulic line is within the range defined by the relief valves 58, 60) and pressure on the hydraulic line 46 exceeds pressure on the hydraulic line 44. Note that a spool 74 of the valve 70 is shifted to the left as viewed in FIG. 5. FIG. 3 depicts the configuration of the control module 42 when the module has been selected and pressure on the hydraulic line 44 exceeds pressure on the hydraulic line 46. Note that the spool 74 is shifted to the right as viewed in FIG. 3.

Taking the configuration of the control module 42 as depicted in FIG. 3 first, note that, with the spool 74 shifted to the right, the hydraulic line 44 is in fluid communication with a fluid metering chamber 78 having a floating piston 80 therein. The metering chamber 78 is also in fluid communication with the hydraulic line 46 via a check valve 82, which permits flow from the hydraulic line 46 to the metering chamber, but prevents flow from the metering chamber to the hydraulic line 46. A spring 84 biases the piston 80 upward, in a direction to draw fluid into the metering chamber 78 from the hydraulic line 46.

An output of the metering chamber 78 is also in fluid communication with one side of the piston 72 in the actuator 22. It wilt be readily appreciated that, when pressure above the piston 80 overcomes pressure below the piston in the metering chamber 78 plus the biasing force of the spring 84, the piston 80 will displace downward, and fluid in the chamber will be forced into the actuator 22, thereby displacing the piston 72 to the right as viewed in FIG. 3. Since the metering chamber 78 has a known volume, the amount of fluid transferred from the metering chamber to the actuator 22 is known and produces a known displacement of the piston 72.

To transfer the fluid from the metering chamber 78 to the actuator 22, pressure on the hydraulic tine 44 is increased so that it exceeds pressure on the hydraulic line 46 (thereby shifting the spool 74 to the right), and is further increased until the biasing force of the spring 84 is overcome and the piston 80 is displaced downward. To transfer further fluid, pressure on the hydraulic line 44 is decreased, thereby permitting the spring 84 to displace the piston 80 upward and drawing further fluid into the metering chamber 78 from the hydraulic line 46. In this step, pressure on the hydraulic line 44 should not be decreased to a level where it is less than pressure on the hydraulic line 46, or the spool 74 would shift to the left.

Pressure on the hydraulic line 44 is then increased again so that the biasing force of the spring 84 is overcome and the piston 80 is again displaced downward, thereby transferring the fluid into the actuator 22. It will be readily appreciated that the metering chamber 78, piston 80, spring 84 and check valve 82 make up a pump responsive to pressure fluctuations on the hydraulic line 44 to transfer fluid from the hydraulic line 46 to the actuator 22.

Now taking the configuration of the control module 42 as depicted in FIG. 5 (i.e., the control module 42 being selected and pressure on the hydraulic line 46 exceeding pressure on the hydraulic line 44 as described above), note that, with the spool 74 shifted to the left, the hydraulic line 46 is in fluid communication with a fluid metering chamber 76 having a floating piston 86 therein. The metering chamber 76 is also in fluid communication with the hydraulic line 44 via a check valve 88, which permits flow from the hydraulic line 44 to the metering chamber, but prevents flow from the metering chamber to the hydraulic line 44. A spring 90 biases the piston 86 upward, in a direction to draw fluid into the metering chamber 76 from the hydraulic line 44.

An output of the metering chamber 76 is also in fluid communication with one side of the piston 72 in the actuator 22. It will be readily appreciated that, when pressure above the piston 86 overcomes pressure below the piston in the metering chamber 76 plus the biasing force of the spring 90, the piston 86 will displace downward, and fluid in the chamber will be forced into the actuator 22, thereby displacing the piston 72 to the left as viewed in FIG. 5. Since the metering chamber 76 has a known volume, the amount of fluid transferred from the metering chamber to the actuator 22 is known and produces a known displacement of the piston 72.

To transfer the fluid from the metering chamber 76 to the actuator 22, pressure on the hydraulic line 46 is increased so that it exceeds pressure on the hydraulic line 44 (thereby shifting the spool 74 to the left), and is further increased until the biasing force of the spring 90 is overcome and the piston 86 is displaced downward. In this step, pressure on the hydraulic line 46 should not be increased to a level where it is outside the control module 42 range of selection pressure determined by the selecting device 48.

To transfer further fluid, pressure on the hydraulic line 46 is decreased, thereby permitting the spring 90 to displace the piston 86 upward and drawing further fluid into the metering chamber 76 from the hydraulic line 44. In this step, pressure on the hydraulic line 46 should not be decreased to a level where it is less than pressure on the hydraulic line 44, or the spool 74 would shift to the right, and pressure on the hydraulic line 46 should not be decreased to a level where it is outside the control module 42 range of selection pressure determined by the selecting device 48.

Pressure on the hydraulic line 46 is then increased again so that the biasing force of the spring 90 is overcome and the piston 86 is again displaced downward, thereby transferring the fluid into the actuator 22. It will be readily appreciated that the metering chamber 76, piston 86, spring 90 and check valve 88 make up a pump responsive to pressure fluctuations on the hydraulic line 46 to transfer fluid from the hydraulic line 44 to the actuator 22.

Referring again to FIG. 1, a preferred mode of selectively actuating the well tool assemblies 12, 14, 16, 18 is to increase pressure on both of the hydraulic lines 36, 38, until the pressure is within the selection pressure range of at least one of the control modules 24. Note that more than one control module 24 may be selected at one time, if desired, depending upon the pressure ratings of the relief valves in the selecting devices of the control modules. In addition, note that selection of the control module(s) 24 may be accomplished using pressure applied to only one of the hydraulic lines 36, 38 (for example, the hydraulic line 46 of the control module 42 embodiment depicted in FIGS. 2–5), if desired.

Pressure on one of the hydraulic lines 36, 38 is then made greater than pressure on the other of the hydraulic lines to thereby determine the manner of operating the associated actuator. Pressure on the hydraulic line 36 or 38 (whichever had the greater pressure thereon to determine the manner of operating the actuator) is then alternately increased and decreased to thereby transfer known volumes of fluid incrementally from the other hydraulic line to the actuator, producing incremental displacements of a piston of the actuator.

Figure 6:
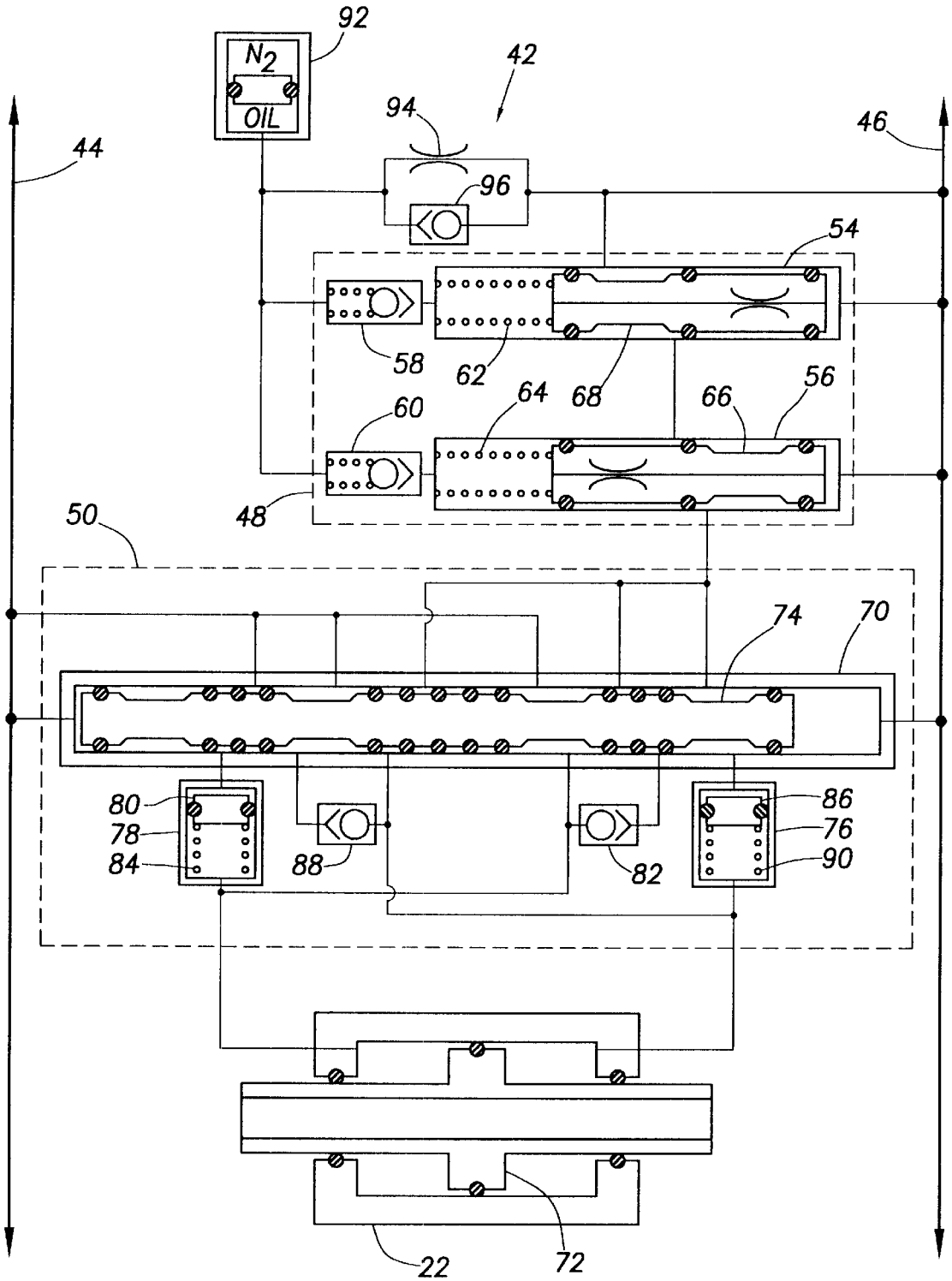
FIG. 6 is a schematic view of a second apparatus usable in the method of FIG. 1, the second apparatus embodying principles of the present invention.

Referring additionally now to FIG. 6, an alternate configuration is representatively illustrated in which the pressure reference source is an accumulator 92, instead of the annulus 52 as depicted in FIGS. 2–5. The accumulator 92 is connected to the relief valves 58, 60 in place of the connection to the annulus 52. In addition, a restrictor 94 and a check valve 96 permit fluid flow between the accumulator 92 and the hydraulic line 46, so that the accumulator is continuously equalized with the hydrostatic pressure of the hydraulic line 46, but pressure on the hydraulic line 46 may be increased to shift the valves 54, 56 if desired. For this purpose, the restrictor 94 permits only very gradual equalization of pressure between the hydraulic line 46 and the accumulator 92.

Figure 7:
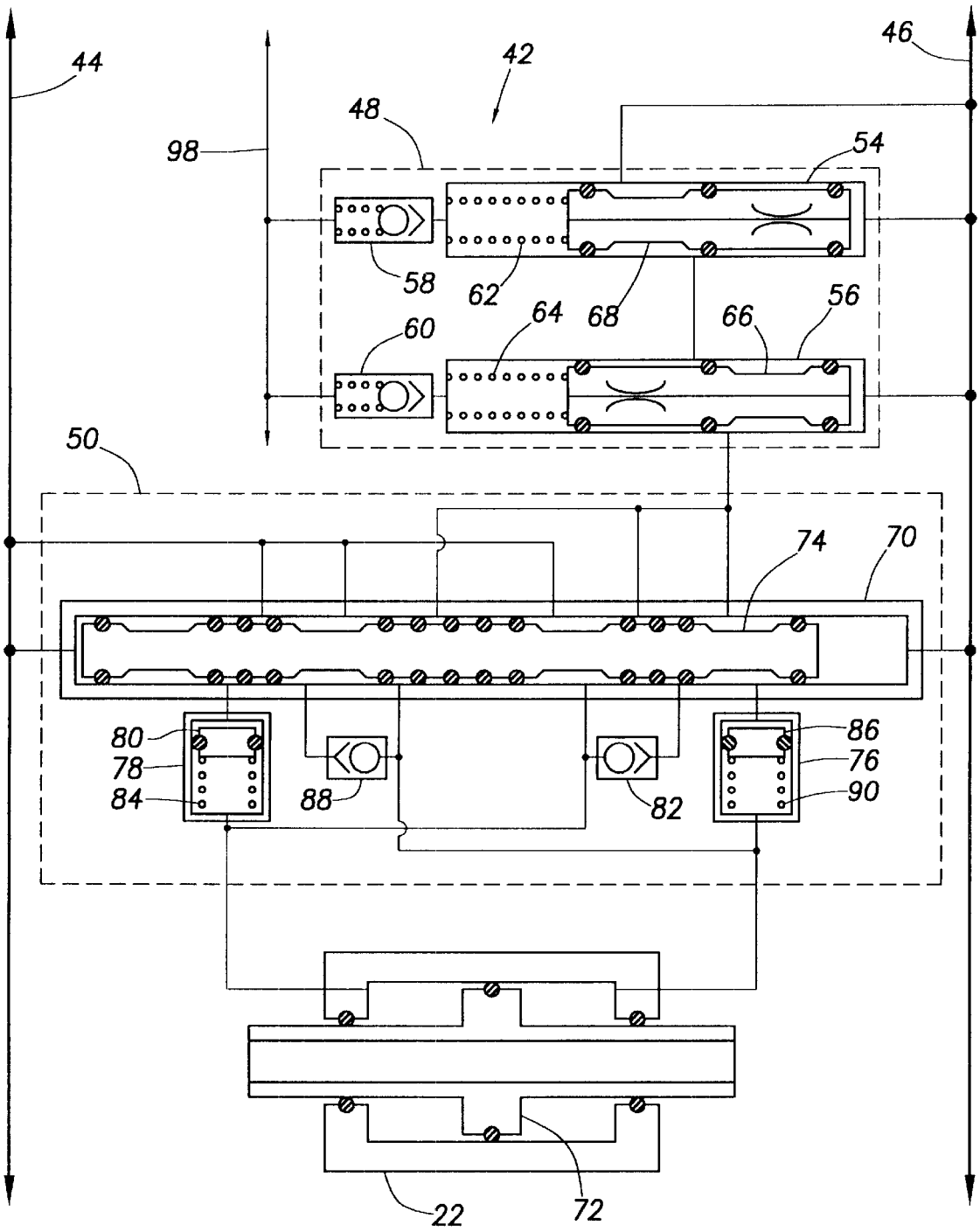
FIG. 7 is a schematic view of a third apparatus usable in the method of FIG. 1, the third apparatus embodying principles of the present invention.

Referring additionally now to FIG. 7, an alternate configuration is representatively illustrated in which the pressure reference source is a third hydraulic line 98, instead of the annulus 52 as depicted in FIGS. 2–5. The hydraulic line 98 is connected to the relief valves 58, 60 in place of the connection to the annulus 52. The hydraulic line 98 provides an additional benefit in that the pressure on the hydraulic line 98 may be varied at a remote location to thereby influence the range of pressures on the hydraulic line 46 at which the control module 42 is selected. For example, the hydraulic line 98 may be connected to the hydraulic control unit 40 in the method 10 as depicted in FIG. 1.

It is to be clearly understood that other types of reference pressure sources may be used in place of the annulus 52, the accumulator 92 and the hydraulic line 98, without departing from the principles of the present invention.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of selectively controlling actuation of multiple well tool assemblies, the method comprising the steps of:

positioning the multiple well tool assemblies in a well;

connecting first and second hydraulic lines to each well tool assembly;

selecting a first one of the well tool assemblies for actuation thereof by generating a predetermined first fluid pressure on at least the second hydraulic line; and actuating the first well tool assembly by generating a second fluid pressure on the first hydraulic line, the second fluid pressure being greater than the first fluid pressure.

2. The method according to claim 1, further comprising the step of selecting a second one of the well tool assemblies for actuation thereof by generating a predetermined third fluid pressure on at least the second hydraulic line.

3. The method according to claim 2, further comprising the step of actuating the second well tool assembly by generating a fourth fluid pressure on the first hydraulic line, the fourth fluid pressure being greater than the third fluid pressure.

4. The method according to claim 1, wherein the actuating step further comprises transferring fluid from the second hydraulic line to an actuator of the first well tool assembly in response to generation of the second fluid pressure on the first hydraulic line.

5. The method according to claim 1, wherein the actuating step further comprises alternating pressure on the first hydraulic line between the first and second fluid pressures, thereby incrementally displacing a piston in an actuator of the first well tool assembly.

6. The method according to claim 1, wherein the actuating step further comprises alternating pressure on the first hydraulic line between the first and second fluid pressures, thereby repeatedly metering a known volume of fluid from the second control line to an actuator of the first well tool assembly.

7. The method according to claim 1, wherein the selecting step further comprises comparing the first fluid pressure to a pressure in an annulus of the well about the first well tool assembly.

8. The method according to claim 7, wherein in the selecting step, the first well tool assembly is selected when the first fluid pressure is greater than the annulus pressure by a predetermined amount.

9. The method according to claim 7, wherein in the selecting step, the first well tool assembly is selected when the first fluid pressure is within a predetermined pressure range, a lower limit of the pressure range being greater than the annulus pressure by a predetermined amount.

10. The method according to claim 1, wherein the selecting step further comprises comparing the first fluid pressure to a pressure in an accumulator.

11. The method according to claim 10, wherein in the selecting step, the first well tool assembly is selected when the first fluid pressure is greater than the accumulator pressure by a predetermined amount.

12. The method according to claim 10, wherein in the selecting step, the first well tool assembly is selected when the first fluid pressure is within a predetermined pressure range, a lower limit of the pressure range being greater than the accumulator pressure by a predetermined amount.

13. The method according to claim 1, wherein the selecting step further comprises comparing the first fluid pressure to a pressure in a third hydraulic line connected to each of the well tool assemblies.

14. The method according to claim 13, wherein in the selecting step, the first well tool assembly is selected when the first fluid pressure is greater than the third hydraulic line pressure by a predetermined amount.

15. The method according to claim 13, wherein in the selecting step, the first well tool assembly is selected when the first fluid pressure is within a predetermined pressure range, a lower limit of the pressure range being greater than the third hydraulic line pressure by a predetermined amount.

16. A system for selectively actuating multiple well tool assemblies, the system comprising:

multiple hydraulic lines connected to multiple well tool assemblies in a well, each of the hydraulic lines being connected to an actuation control module of each of the well tool assemblies;

each actuation control module including a selecting device and a fluid metering device, with each selecting device and fluid metering device having a corresponding well tool assembly;

each selecting device comparing pressure on a second one of the hydraulic lines to a reference pressure source, the corresponding well tool assembly of the selecting device being selected when the second hydraulic line pressure is greater than the reference pressure by a corresponding first predetermined amount; and each fluid metering device transferring fluid from the second hydraulic line to an actuator of the corresponding well tool assembly in response to alternating pressure increases and decreases on a first one of the hydraulic lines when the corresponding well tool assembly is selected.

17. The system according to claim 16, wherein the reference pressure source is an annulus disposed about the corresponding well tool assembly in the well.

18. The system according to claim 16, wherein the reference pressure source is an accumulator.

19. The system according to claim 18, wherein the reference pressure of the accumulator is equalized with the second hydraulic line pressure.

20. The system according to claim 16, wherein the reference pressure source is a third one of the hydraulic lines.

21. The system according to claim 16, wherein each well tool assembly is deselected for actuation thereof when the second hydraulic line pressure exceeds the reference pressure by a corresponding second predetermined amount.

22. The system according to claim 16, wherein each fluid metering device includes a metering chamber, the chamber discharging a known volume of fluid therefrom to the actuator of the corresponding well tool assembly of the fluid metering device when it is selected for actuation thereof and pressure on the first hydraulic line is decreased.

23. The system according to claim 16, wherein each fluid metering device transfers fluid from the first hydraulic line to the actuator of the corresponding well tool assembly of the fluid metering device in response to alternating pressure increases and decreases on the second hydraulic line when the corresponding well tool assembly is selected.

24. An actuation control module for selectively actuating a well tool assembly in a well, first and second hydraulic lines and a reference pressure source being disposed in the well, the control module comprising:

a fluid metering device; and a selecting device including first and second valves interconnected in series between the second hydraulic line and the fluid metering device, the first valve opening when pressure on the second hydraulic line is greater than a reference pressure by a first predetermined amount, and the second valve closing when pressure on the second hydraulic line is greater than the reference pressure by a second predetermined amount.

25. The control module according to claim 24, wherein the fluid metering device includes a first pump transferring fluid from the second hydraulic line via the first and second valves to a first output of the control module in response to alternating pressure increases and decreases on the first hydraulic line.

26. The control module according to claim 25, wherein the fluid metering device further includes a second pump transferring fluid from the first hydraulic line to a second output of the control module in response to alternating pressure increases and decreases on the second hydraulic line.

27. The control module according to claim 25, wherein the first pump includes a metering chamber, wherein each pressure increase on the first hydraulic line causes a discharge of a known volume of fluid from the metering chamber to the first output, and wherein each pressure decrease on the first hydraulic line causes the known volume of fluid to be received in the metering chamber from the second hydraulic line.

28. The control module according to claim 25, wherein the first hydraulic line pressure varies between a first pressure approximately equal to the second hydraulic line pressure and a second pressure greater than the second hydraulic line pressure in order to transfer fluid from the second hydraulic line to the first output.

29. The control module according to claim 24, wherein the fluid metering device includes a spool valve selectively interconnecting the first and second hydraulic lines to first and second pumps of the fluid metering device, the spool valve having a first configuration in which the first pump transfers fluid from the second hydraulic line to a first output of the control module in response to pressure fluctuations on the first hydraulic line, the first configuration being selected in response to pressure on the first hydraulic line being greater than pressure on the second hydraulic line, and the spool valve having a second configuration in which the second pump transfers fluid from the first hydraulic line to a second output of the control module in response to pressure fluctuations on the second hydraulic line, the second configuration being selected in response to pressure on the second hydraulic line being greater than pressure on the first hydraulic line.

* * * * *